US010036167B1

(12) United States Patent
Wolff et al.

(10) Patent No.: US 10,036,167 B1
(45) Date of Patent: Jul. 31, 2018

(54) APPARATUS AND METHODS FOR IMPROVED BUILDING LIGHTING

(71) Applicants: Kevin Alan Wolff, Apex, NC (US); Harrison Robert Wolff, Apex, NC (US); Benjamin Grayson Wolff, Apex, NC (US); Mary Louise M. Wolff, Apex, NC (US)

(72) Inventors: Kevin Alan Wolff, Apex, NC (US); Harrison Robert Wolff, Apex, NC (US); Benjamin Grayson Wolff, Apex, NC (US); Mary Louise M. Wolff, Apex, NC (US)

( * ) Notice: Subject to any disclaimer, the term of this patent is extended or adjusted under 35 U.S.C. 154(b) by 648 days.

(21) Appl. No.: 14/214,813

(22) Filed: Mar. 15, 2014

Related U.S. Application Data

(60) Provisional application No. 61/802,434, filed on Mar. 16, 2013.

(51) Int. Cl.
*E04D 13/03* (2006.01)
*E04D 13/035* (2006.01)
*F21S 19/00* (2006.01)

(52) U.S. Cl.
CPC ..... *E04D 13/0354* (2013.01); *E04D 13/033* (2013.01); *F21S 19/005* (2013.01); *E04D 13/03* (2013.01)

(58) Field of Classification Search
CPC ... E04D 12/03; E04D 12/033; E04D 12/0354; F21S 19/005
USPC ..... 52/28, 200
See application file for complete search history.

(56) References Cited

U.S. PATENT DOCUMENTS 2,749,429 A * 6/1956 Wavell ..... E04H 1/14 250/214 AL
3,113,728 A * 12/1963 Boyd ..... E04B 5/46 359/594
5,493,824 A * 2/1996 Webster ..... E04D 13/033 250/203.4
5,528,471 A * 6/1996 Green ..... E04D 13/03 362/147
5,662,403 A * 9/1997 Akashi ..... F21S 8/02 362/292
5,675,487 A * 10/1997 Patterson ..... E06B 9/32 160/7
6,142,645 A * 11/2000 Han ..... E04D 13/0325 362/147
7,736,014 B2 * 6/2010 Blomberg ..... E04D 13/033 359/591

(Continued)

FOREIGN PATENT DOCUMENTS

CA 2733146 A1 * 2/2010 ..... F24J 2/14
EP 2321587 B1 * 5/2016 ..... F24J 2/14
WO WO 9406979 A1 * 3/1994 ..... E04B 9/32

*Primary Examiner* — Robert Canfield
(74) *Attorney, Agent, or Firm* — Wolff Law Offices, PLLC; Kevin Wolff

(57) ABSTRACT

The present invention is directed generally to a new flat or A-frame pop-up canopy, shelter, cover, and/or awning, to the integration of skylights and electrical lights systems, to clocks and watches that can record a persons preferred alarm voice or video, winter gloves made to look like or with caricatures formed with or on them, digital radio and TV systems with a method of overcoming lost signal interruptions, and a single vent HVAC temperature control systems. Each of these approaches make life easier and/or more fun for people.

20 Claims, 4 Drawing Sheets

(56) References Cited

U.S. PATENT DOCUMENTS

| | | | | |
|---|---|---|---|---|
| 7,995,277 | B2 * | 8/2011 | Patterson | E04D 13/033 359/591 |
| 8,376,600 | B2 * | 2/2013 | Bartol | E04D 13/03 359/597 |
| 8,585,269 | B1 * | 11/2013 | Zincone | E04D 13/033 362/147 |
| 8,814,374 | B2 * | 8/2014 | Van Der Poel | E06B 9/30 362/1 |
| 8,833,970 | B2 * | 9/2014 | Lopez Querol | E04D 13/03 359/595 |
| 9,080,763 | B2 * | 7/2015 | Yoder | F21V 33/006 |
| 9,360,182 | B2 * | 6/2016 | Wemmer | F21S 11/00 |
| 2005/0081462 | A1 * | 4/2005 | Mulford | E04D 13/033 52/200 |
| 2005/0201075 | A1 * | 9/2005 | Gandhi | F21S 19/005 362/1 |
| 2006/0007549 | A1 * | 1/2006 | Zincone | E04D 13/033 359/591 |
| 2008/0250735 | A1 * | 10/2008 | Patterson | E04D 13/033 52/200 |
| 2008/0310147 | A1 * | 12/2008 | Blomberg | E04D 13/033 362/147 |
| 2010/0039799 | A1 * | 2/2010 | Levens | F21S 8/02 362/147 |
| 2012/0087113 | A1 * | 4/2012 | McClellan | E04D 13/03 362/147 |
| 2012/0134170 | A1 * | 5/2012 | Bracale | E04D 13/033 362/555 |
| 2014/0117877 | A1 * | 5/2014 | Mapel | H05B 33/086 315/294 |
| 2015/0354223 | A1 * | 12/2015 | Biron | E04D 13/033 362/276 |

* cited by examiner

APPARATUS AND METHODS FOR IMPROVED BUILDING LIGHTING

This patent application claims priority to and the benefit of provisional patent application Ser. No. 61/802,434 filed on Mar. 16, 2013, which is hereby incorporated by reference.

FIELD OF THE INVENTION

The present invention pertains to making our lives easier, for example, by introducing products that are easier to use, more efficient, more cost effective, fun, and eliminate problems that we experience in our everyday life. More particularly, the present invention relates to the fields of pop-up canopy, shelter, cover, and/or awnings; skylights and electrical lights systems, clocks and watches, gloves, radio and TV systems, and HVAC systems and control. Each of these areas can be improved so that our daily life is better.

BACKGROUND

In the areas of, for example, portable or temporary shelters such as pop-up canopy, shelter, cover, and/or awnings, many people have been making, buying, and using quick pop-up type portable canopies that are easy to carry and mobile so that it can be put up, taken down, repackaged and/or stored easily. These portable pop-up canopies typically have metal frames that are retractable and adjustable for height when in use and size reduction for storage, and form a pyramid type shape on top when open. The pyramid top of the portable canopy is typically made of a waterproof material that is also stitched into a pyramid shape to match the metal frame that supports it. There is also known metal frame gazebos that also have the pyramid shaped type top on them. However, one problem with these pop-up canopies and gazebos is that when it rains, water runs down all four sides. So getting under or out from under them during rain causes a person to get wetter than simply standing in the rain. Also, if these shelters are used next to, for example, a building, such as putting them up on a deck or patio next to or attached to a house or garage, the water runs back against the wall or a door wall of the house or garage causing unwanted water flowing in a bad direction toward the building rather than away from the building. There are also known elongated garage style shelters (shaped to park an automobile under) that have an "A" frame style, which also may have problems with rain water going in the wrong direction if one of the lower sides of the "A" frame shape is directed to the side of the building, which often is the case for decks that are wider than they are long to accommodate the elongated garage style shelter. The present invention may include a portable pop-up shelter that is capable of being adjusted so that it has a single plane slanted roof line that may overcome the rain water runoff of the presently known shelters.

Many buildings today skylights have in their roof for using natural sunlight to fully or partially light the inside of a building. These buildings also have electrical light fixtures and systems that provide electrical artificial light using, for example, incandescent lights or other type of light bulbs for use with or without the natural light which are typically switched on by a user or automatically based on the time of day. Unfortunately, the installation of these two different methods and systems for lighting are done separately and take up two different parts of the ceiling space in a building. The present invention may include an integral system or module including a skylight for natural light and an electric operated lighting fixture that may be used in the same part of a building ceiling and may be installed in a single installation.

Many clocks and watches have been known over time, and many of them have alarms to wake a person or warn them of something. However, clocks and watches have not had electronic memory and can not remember random information or create unique recordings or alarm messages. Nor can they save video and do not have touch screens. However, with the low cost of touch screens and the low cost and small size of electronic memory, the present invention may include watches and/or clocks that have memory to enable a recordable and programmable message alarm clock with a touch screen for inputting information and playing back a recorded audio and/or video message that may be used as an alarm or a reminder for the user.

Many types of gloves have been known in the past. Some of them have been made to be used in cold weather and may be worn when skiing. Also, many people who ski have been known to wear funny hats and/or pants to distinguish themselves from other on the slopes. However, the present invention may include fun styled gloves to distinguish people, for example, when skiing. They may include, for example, designs and/or characters or caricatures such as a dog face, a cat face, a three headed dragon, etc.

There have been many types of radio and TV systems made in the past. Recently digital and satellite TV and Radio have come to replace old analog TV and radio. However, one problems with digital and satellite TV and there being skips and breaks in the signal or coverage. The present invention may include a system and method for making a clearer signal playback on digital or satellite radio or TV.

Traditional HVAC forced air systems have a single thermostat for temperature control and registers and/or vents to control the amount of heated or cooled air that is circulated through a particular room of a building. The registers and/or vents are manually set once in a while by a maintenance person (commercial building) or a home owner (residential property) so that generally the temperature in each room is somewhat regulated on a typical day. However, each room of a building typically does not reach a comfortable level regardless of where the registers or vents are set and so they need to be manually adjusted or the entire systems temperature setting must be adjusted at the single thermostat. Recently, some HVAC systems have been introduce with single room register or vent replacements that help to make adjustments to the air flow for each room (see, e.g., invent systems), but these systems have large, bulky, and relatively unusual register/vent adjustable outlets that look out of place in most room decors (look unusual relative to the typical vent or register grates or louvers) and there are separate thermostats and temperature sensors added in each room that communicate via radio control. The present invention may integrate the individual room system into a single per vent/register output system that cooperates with the main thermostat and the individual rooms HVAC systems to appear visually typical and provide temperature balance to each room in the HVAC system so that all the rooms in a building attached to the same system are closer to the desired temperature level of the user.

SUMMARY

The present invention is directed generally to various apparatus and methods for making our lives easier, for example, by introducing products that are easier to use, more efficient, more cost effective, fun, and eliminate problems that we experience in our everyday life. For example, in one embodiment the present invention may include a portable pop-up shelter that is capable of being adjusted so that it has a single plane slanted roof line that may overcome the rain water runoff of the presently known shelters. In another embodiment, the present invention may include an integral system or module including a skylight for natural light and an electric operated lighting fixture that may be used in the same part of a building ceiling and may be installed in a single installation. In a further embodiment, the present invention may include watches and/or clocks that have memory and enable a recordable and programmable message alarm which may include a touch screen for inputting information and playing back a recorded audio and/or video message that may be used as an alarm or a reminder for the user. In a still further embodiment, the present invention may include fun styled gloves to distinguish people, for example, when skiing. They may include, for example, designs and/or characters or caricatures such as a dog face, a cat face, a three headed dragon, etc. In an even further embodiment, the present invention may include a system and method for making a clearer signal playback on digital or satellite radio or TV by, for example, including electronic memory that stores an earlier version of the pre-recorded signal received in, for example, a separate band of the received transmission signal. And in one embodiment, the present invention may integrate the individual room system into a single per vent/register output system that cooperates with the main thermostat and the individual rooms HVAC systems to appear visually typical and provide temperature balance to each room in the HVAC system so that all the rooms in a building attached to the same system are closer to the desired temperature level of the user.

Still further aspects included for various embodiments will be apparent to one skilled in the art based on the study of the following disclosure and the accompanying drawings thereto.

BRIEF DESCRIPTION OF THE DRAWINGS

The objects, features and advantages of the present invention will become more readily apparent to those skilled in the art upon reading the following detailed description, in conjunction with the appended drawings, in which.

DETAILED DESCRIPTION

The present invention is directed generally to an apparatus and method related to building sky lights with electrical lighting, single plane slanted roof pop-up shelter, watches or clocks with recordable message alarm, fun style gloves for winter sports, a means for reducing dead spots in satellite or digital radio or television, and/or per vent adjustable HVAC system. There present patent application discloses these inventions generally but in enough detail so that one skilled in the art may understand the invention and design a working embodiment for each one, without disclosing excess information already within the purview of one skilled in the particular art. However, one skilled in the art would also recognize that the embodiments disclosed herein are merely exemplary, and variations thereof or there from may be made and still be in the purview of the present invention.

Figure 1A:
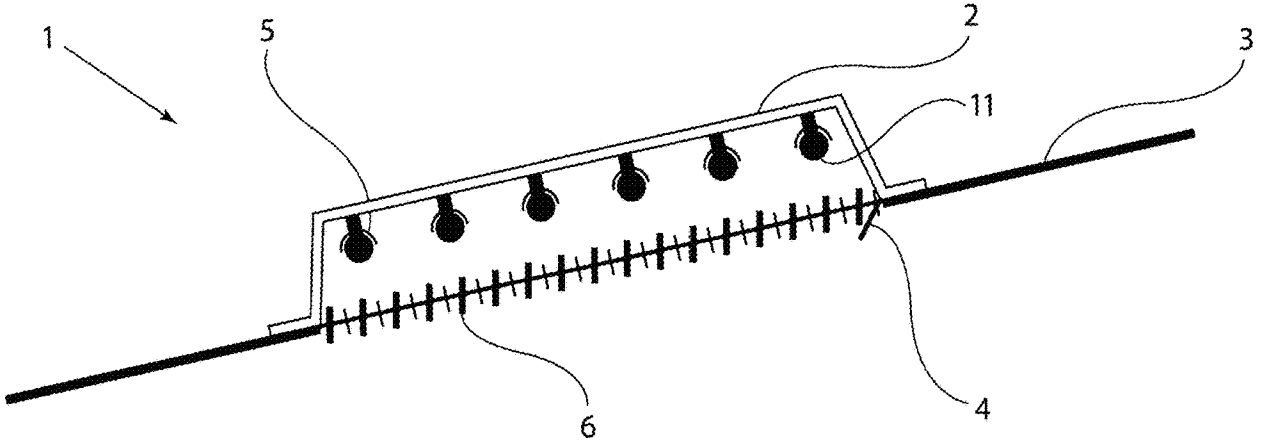
FIGS. 1A, 1B, and 1C are a side partial cut away view, a perspective view, and a side partial cut away view with block diagram of electrical components, for one embodiment the present invention related to a skylight and electrical light module for easy efficient installation and cost savings (construction and energy), according to an exemplary embodiment of the invention.
Figure 1B:
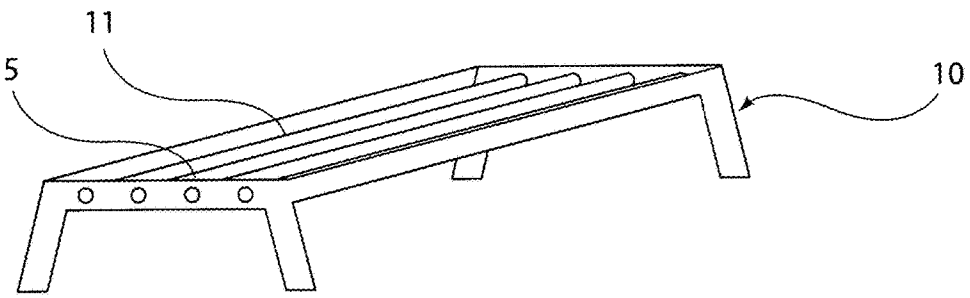
Figure 1C:
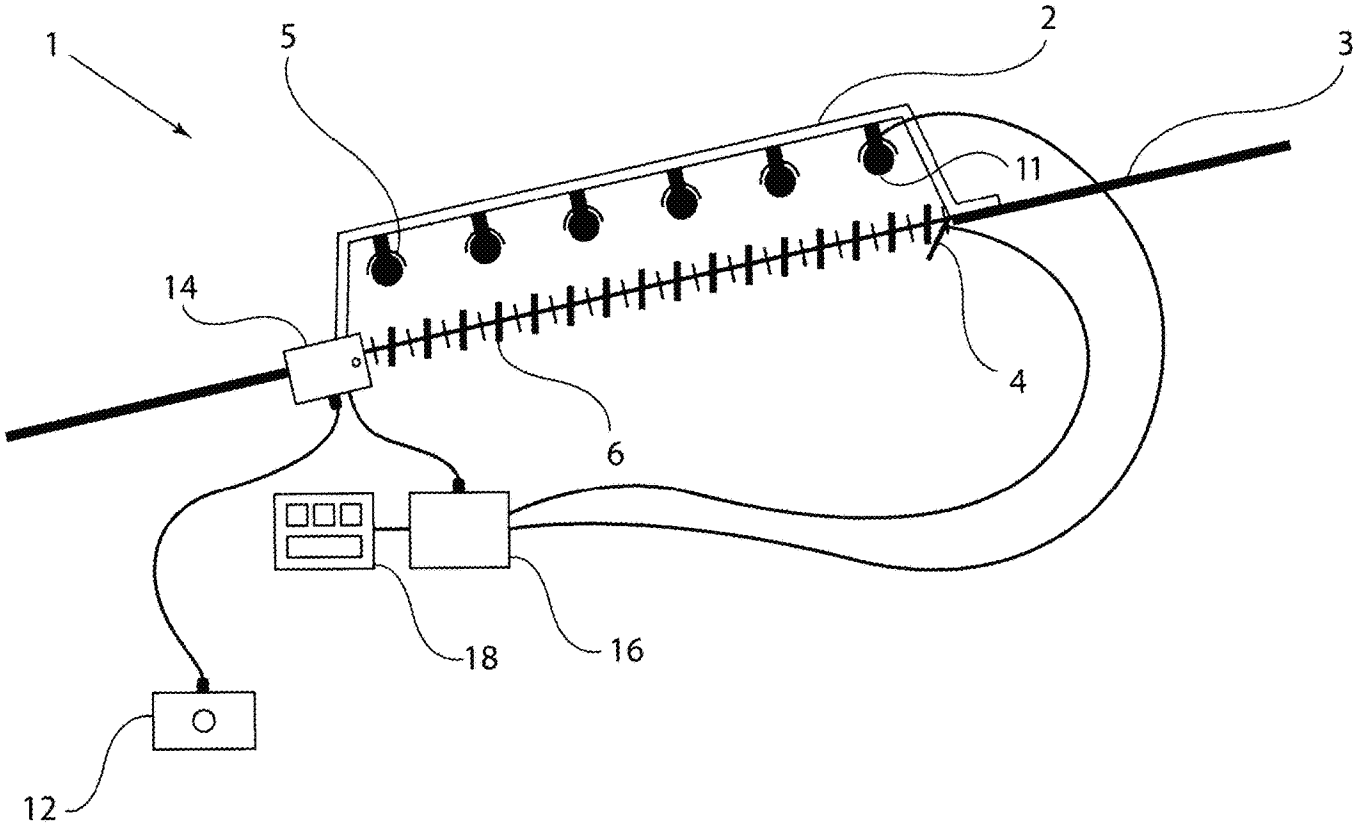

A first embodiment shown in FIGS. 1A-1C illustrates one possible embodiment for a skylight/electrical light fixture module 1 may be used in a home or commercial building for combining an electrical light fixture with a skylight fixture into a single unit and thereby providing a space efficient and energy efficient method of providing light in a building. The invention may include a light admitting shell 2 for letting in natural light, similarly or the same as would a typical building roof mounted skylight, and an internal electrical light fixture 1 for providing electrical light when needed or desired. The shell 2 may be made out of, for example, plastic (tinted or not), Plexiglas, or regular glass. The electrical light fixture portion may be mounted on and internal frame 10 with electrical light(s) 11 attach thereto. In one embodiment the light fixture within a skylight is smart in electricity conservation and may be very bright using, for example, fluorescent bulbs, high intensity bulbs, LED bulbs, etc. It may have shades or automatic shutters 6 in case, for example, the natural light from the sun is too bright in the area it is covering in a residential or commercial building. The lights 11 and the automatic shutters 6 may have a related light sensor(s) 4 that senses light and can help determine if the sun is out or not, and what particular amount of light is being dissipated from the lower side of the unit. The light sensor(s) 4 may be coupled to, for example, a microprocessor with software to determine the ambient light and may adjust the intensity of the light(s) 11 and/or the opening and closing of the automatic shutters 6 according to a desired light intensity inside a building. If the sun is not out or is somewhat shaded, then the lights 11 will turn on, and if the sun is out then they dim and/or go out. Similarly, if the sun is extremely bright, the automatic shutters 6 may close as needed to dim the natural light. The automatic shutters may be made of, for example, metal, glass, or plastic, and may be able to provide anywhere from complete elimination of light there through, and/or a filtering of the light to eliminate UV rays or certain types of light. In fact, the automatic shutters 6 may be a two-way type of design so that when closed in one direction they eliminate some or all of the light, and when closed in the other direction (e.g., 180 degrees opposite) they magnify the amount of light that will come through.

The light(s) 11 may be protected from direct sunlight by a shield 5. The shield 5 may be made out of, for example, metal, plastic (tinted or not), Plexiglas, or regular glass. The shield 5 may include a mirror surface to increase the intensity of the light(s) 11. The light(s) 11, for example tubular incandescent light tubes, may be hooked or attached to an internal frame 10. The shields 5 in this case with incandescent light tubes may be formed as an elongated curved metal strip that protect the light(s) 11 form the sun. The shields 5 may be polarized (bends sun light to not make bulbs so hot so they would not burn out because of the sun lights intensity). The shutters 6 or louvers could be controlled by a potentiometer 12 or switch on a wall in the building, or as mentioned earlier by the sensor(s) 4 that senses the light waves from the sun/how bright it is outside, and may be driven by a little electric motor 14 (one skilled in the art would know how to design such an electric actuated shutter system). The integral skylight and electrical light system module or unit 1 according to the present invention may be easily put on and off the roof 3 of buildings/houses with for example bolts, so it won't be difficult putting it on and off the roof 3 if it gets old or breaks. Some of the parts to make the unit included, an internal frame 10, a light sensor 4, a single formed or a couple of sealed sheets of plexy-glass or regular glass 2, shutters or louvers 6, one or more polarized shields 5 (per light bulb), and a few bolts (not shown) to attach it to the roof 3 of the building/house/etc., an electric motor 14 connected to the automatic shutter 6, a switch or potentiometer 12 (optional), a microprocessor 16, a programming device 18 (similar to a digital thermostat; optional). The electrical lights 11 may be, for example, LEDs or incandescent tube type light bulbs. The module 1 may be assembled as one unit in a manufacturing plant prior to being installed in or on a hole in the roof 3 of a building. As such, one module could be installed to provide both natural and electrical light, or some combination thereof. The unit or module 1 may include a light sensor 4 and an electronic processor 15 such as a microprocessor 16, that may be programmed to determine when there is not enough natural lighting (sun light) for the building and turn the electrical lights 11 on to the intensity necessary to light the room or building. This may be done by varying the power to the lights 11 and/or adjusting the opening in the shutters or louvers 6. This embodiment would be particularly useful for commercial buildings where saving energy and accumulating thermal heat from the sun may be more beneficial because of the large amount of square footage of the building and the large open rafters or ceilings (e.g., in a large hardware store building or warehouse).

One skilled in the art would readily appreciate and understand how to make and use the skylight and electrical light module invention shown in FIGS. 1A-1C using design and manufacturing methods well know in the art. The various parts of the invention are known in general, but the details and the combination thereof are not.

Figure 2B:
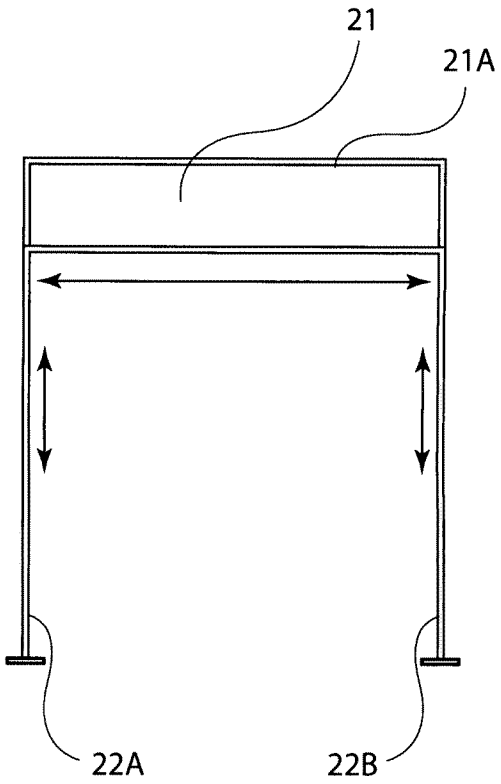
FIGS. 2A and 2B are side views of one embodiment of the present invention related to a easy up and easy down pop-up deck and/or patio awning or shelter, according to an exemplary embodiment of the invention.
Figure 2A:
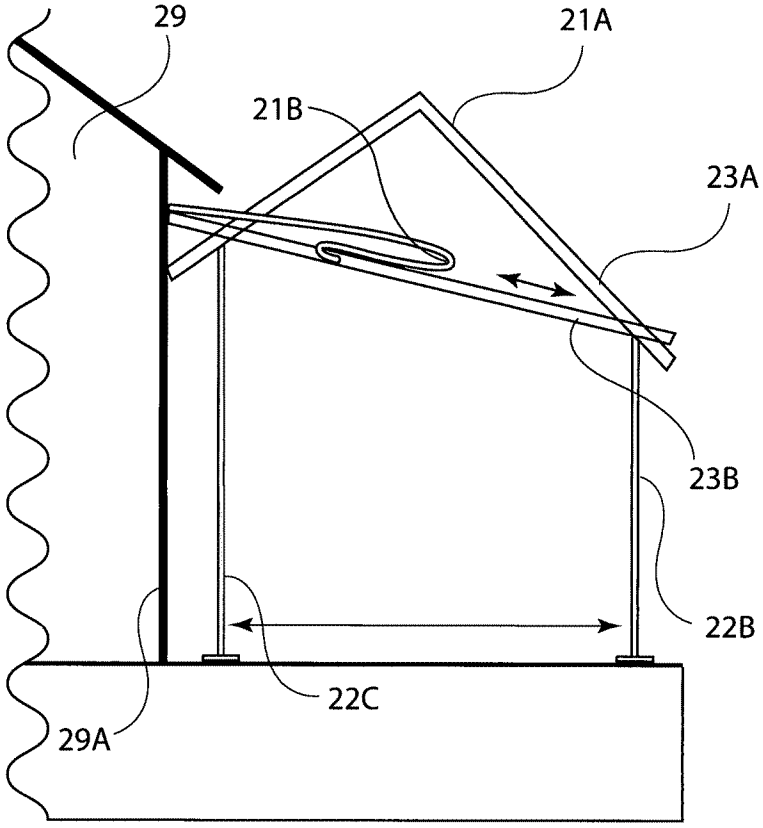

A second embodiment disclosed in FIGS. 2A and 2B illustrates an easy assemble pop-up awning or shelter roof that may be used on, for example, a house deck or patio. In one variation it may be able to be formed in either an "A frame" roof shape or a straight single "plane" roof shape, and may have easy height, width, and length adjustments with a waterproof foldable or malleable roof material such as a waterproof flat rectangular tarp or using similar material to presently known pop-up canopy tops that are formed in a pyramid shape (e.g., polyester, canvas, etc.). This easy up and easy down pop-up awning or shelter roof may be constructed similarly to the presently known pop-up canopies that sell in many department and home improvement stores these days. The leg construction would be similar by having four corner legs 22A, 22B, 22C, and 22D, that are adjustable in height. However, the legs' height adjustment may have more variation and/or length so that one side of the awning or shelter roof may be raised at a higher height than the other, so that when used in a flat angle roof configuration, the side closest to the wall of a building may be raised so that rain water would necessarily run away from the house. The roof material 21 may be polyester or tarp may be placed on top of a framing material 23 may include along one side a means of fastening it together when folder (23B), such as Velcro, that may be used to attach one side of the tarp or polyester roof material along the wall of the building that the pop-up is next to, on for example a deck or a patio of a house 29. In this way it may ensure that rain water can not run down between one sided or end of the polyester or tarp top roof 21 and the wall 29A of the building 29 (similar to affixing the roof of a porch to a house with shingles and an adhesive, but temporary in this case). In this embodiment, the roof support frame material and the legs will be relatively complex in design so that the pop-up may be used in the A-frame and the flat roof design appearance. As such the frame 23, which may be made of metal and plastic portions or pieces like present pyramid shaped pop-up gazebos, will need to be able to lock into an A-frame shape 23A and collapse into a straight roof design 23B. The legs, typically made of metal, will need to be able to be fine adjusted so that they can be used in both the A-frame shape (all four legs 22A, 22B, 22C, and 22D).

Although shown in FIG. 2A having a roof 21 material that may be folded, the pop-up patio or deck roof 21 may be made to be only a slanted roof line 21A as shown in FIG. 2B. In this case the roof material 21A and support frame (legs 22 and roof support frame 23) need not be made to operate as both an A frame and flat roof style, but rather may be made as only a flat roof style 21A. In this case, the roof support frame 23 may be designed to be collapsible in an accordion style frame and open up only into a flat roof support system. The four legs 22A, 22B, 22C and 22D may have the same or two different maximum lengths, and may be fully adjustable in the up/down directions to be approximately 50% to 100% of their maximum possible length, being made up of an inside and an outside section similar to presently available pop-up gazebos. Although, the legs 22 may have a slide adjuster that allows an indefinite number of size adjustment locations for each of the four legs 22.

Furthermore, although the design including the A-frame and flat roof variations are shown this the A-frame version turned in one direction relative to the building wall 29A, one would appreciate that if the pitch of the A-frame were lower than the eve 28 of the building, than the A-frame may be used too also stop rain water from entering under the eve 28 and run away (generally) from the building wall 29A (though not as effective as the flat angled roof 21B version).

One skilled in the art would readily appreciate and understand how to make and use the A frame and flat roof pop-up patio or deck roof invention shown in FIGS. 2A and 2B using design and manufacturing methods well know in the art of pop-up gazebo and/or patio or deck awning design. The various parts of the invention are known in general, but the details and the combination thereof are not. As such, one skilled in the art needs less details to be able to make and use the present pop-up patio and deck roof design that will allow rain water to be directed away from the wall of a house our building adjacent the pop-up patio and deck roof.

Figure 3A:
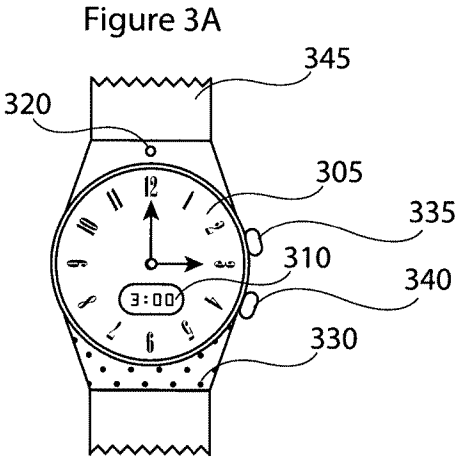
FIGS. 3A and 3B are perspective view of a couple embodiments of the present invention related to a recordable alarm watch and clock, respectively, according to an exemplary embodiment of the invention.
Figure 3B:
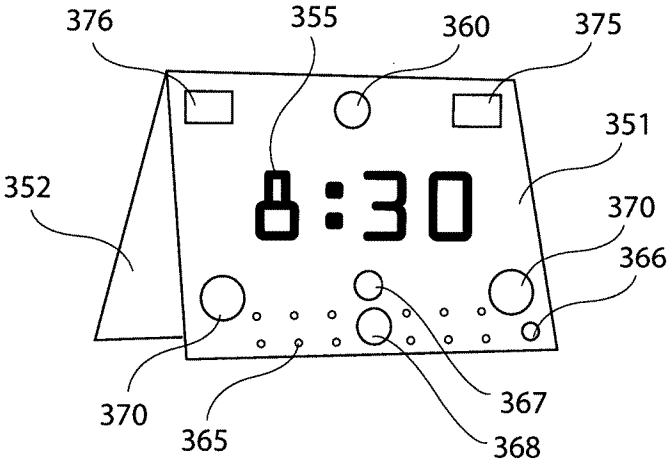

A third embodiment disclosed in FIGS. 3A and 3B illustrates a watch 300 and a table or travel alarm clock 350 that may include a recording device to record any sound, saying and/or image (still or moving) that a user wishes to hear and/or see to remind them of an appointment or a time to do something. For example, the watch 300 or clock 350 recorder may include an integrated circuit including an A/D converter, digital memory chip and/or microprocessor that can store a digital recording of the users voice and/or an image (still or motion) or any other sound or image, by speaking into a microphone 330 or 366 and/or looking into a digital camera 320 or 360 when depressing a record button 335 or 370. This recording may then be played back on, for example, a screen 305 or 355 (digital, and may be a touch screen) and through a speaker 330 and 365 when a time occurs that has been programmed into the alarm feature of the watch 300 or clock 350.

Referring to FIG. 3A, in one embodiment a watch 300 with a recordable alarm clock feature that may include an analog readout 305 (that may be part of a digital screen), a digital readout 310, a camera 320, a combination speaker and microphone 330, a multifunction button 335 for the set alarm and record feature, a multifunction button 340 to set and/or reset the clock. The watch 300 may have a camera 320 and/or a microphone 330 coupled to a digital memory (internal) so you can talk and look into it, and record your own alarm message. With the microphone 330, by depressing the multifunction button 335, you can record what it is that you want the alarm to say, for example, to say "get up now" to wake you up in the morning.

Referring to FIG. 3B, in one embodiment a travel table alarm clock 350 with a recordable alarm clock feature that may include a digital readout display 355 (that may be part of a digital screen), a digital number readout 351, a camera 360, a speaker 365, a microphone 366, and a stand/cover 352, and an internal memory and/or microprocessor or electronic processor. The alarm clock may also include a few Set/Reset buttons, such as speaker set and reset buttons 367 and 368, clock/alarm set 370 and reset 371 buttons, and picture set 375 and reset 376 buttons, for the set clock, set alarm and set record feature.

When you speak into the microphone 366 with the Set button 370 depressed, the alarm will store what you say in, for example, a digital memory. This alarm message will remain unless you Reset it (reset button 371) or change it by recording a new alarm message. The alarm message will still have the earlier recording in the memory unless a new one is added or the reset button 371 is used. The same thing will happen with the picture when you set it with the Set Picture 375 button and reset it with the Reset Picture 376 button. The clock 350 may also have a touch screen 351 so you can touch the buttons for setting the time, recording your message or alarm, etc. There may also be an art enhancement button (not shown) programmed into the clock 350 so you can draw on the picture on the screen, for example, make a caricature of a person or whatever is on the screen. To make a basic version, the clock 350 may include, for example, a microphone, touch screen, speakers, frame, stands, a camera, and an electronic digital processor. Some items that could be included on the touch screen may include the digital time, picture buttons, time buttons, speaker buttons, and microphone buttons. One of the unique aspect of this alarm clock 350 is that it may replay for you a video and/or audio message of whatever you want on it, which may be self recorded or downloaded using wireless technologies such as wi/fi or bluetooth. Also the clock 350 may have its own voice recording feature so you can wake up to whatever you put on it. Also if you want to make the pictures look funny you can draw on them with the art enhancement button.

In one embodiment, the alarm watch/clock may be the same physical device that is used interchangeably. By limiting the size of the watch/clock main section and screen to, for example only 2×2 inches, the device may be an appropriate size to be used for both an alarm watch or an alarm clock. As previously discussed, this version of the alarm clock may have a camera and/or a microphone coupled to a digital memory so you can talk and look into it, and record your own alarm message. In one variation, a strap 345 may be included in the case it is to be used as a watch, and a stand/cover 352 if it is to be used as a clock. In either case, when recording an alarm the use may use the camera 320 or 360, and the watch/clock may be able to take your picture and put it on the digital screen so you will know who put the voice alarm on it. In either case, the microphone 330 or 366 you can record an alarm to say what you want it to when, for example, you use the alarm to wake up in the morning; like "hey lazy bones, get up now!" For the table part of the clock 350 may have a stand 352 hinged on the back (rather than strap 345) to set it standing up on a table top. The stand 352 may also act as a cover for the clock and be hinged to a housing 351 or side of the clock 350. One of the unique aspects of this alarm watch/clock may include the ability to replay for you a video and/or audio message of information that is of particular interest to you and which is specifically recorded by you. Also if you want to make a recorded pictures or video look funny you, you can draw on them with the art enhancement button.

One skilled in the art would readily appreciate and understand how to make and use the watch/clock with personally recorded alarm invention shown in FIGS. 3A and 3B using product design parts and manufacturing methods well know in the art of electronics and flat/touch screens. The various parts of the invention are known in general, but the details and the combination thereof are not. As such, one skilled in the art needs less details to be able to make and use the present personalized alarm recording watch/clock according to the invention.

All publications, patent applications, and patents cited herein are hereby incorporated by reference in their entirety for all purposes.

The invention claimed is:

1. An apparatus, comprising:

an electric light skylight fixture module including:

a shell having a natural light admitting area through which natural light is admitted into a building;

a frame fitted inside the light admitting area of the shell;

a plurality of electric lights mounted to the frame and spanning the natural light admitting area within the shell; and a plurality of automatically adjustable louvers mounted below the shell and the plurality of electric lights.

2. The apparatus of claim 1, wherein the electric light skylight fixture module further comprises;

a control system for automatically adjusting the louvers or electrical lights.

3. The apparatus of claim 2, wherein the shell is formed of a plastic, glass or plexiglass material.

4. The apparatus of claim 3, wherein the plurality of electric lights mounted to the frame and the shell are integrally formed as a single module.

5. The apparatus of claim 2, wherein the electric light skylight fixture module further comprises;

a plurality of shields covering the plurality of electric lights.

6. The apparatus of claim 2, wherein the louvers are made from a light admitting material that filters the natural light that enters a building.

7. The apparatus of claim 2, wherein the louvers include a mirrored surface to enhance the light from the electric light or natural light that enters a building.

8. An apparatus, comprising:

an electric light and skylight fixture including:

a light admitting shell for mounting to a roof and letting in natural light to a building; and an internal electric light fixture including at least one electric light for providing electrical light when needed or desired; and a plurality of automatically adjustable louvers mounted below the light admitting shell and the plurality of electric lights, wherein the internal electric light fixture is housed completely within the light admitting shell.

9. The apparatus of claim 8, wherein the electric light and skylight fixture further comprises:

a frame that fits inside the light admitting shell; and a plurality of electric lights mounted to the frame.

10. The apparatus of claim 9, wherein the electric light and skylight fixture further comprises;

a control system for automatically adjusting the louvers or electrical lights.

11. The apparatus of claim 10, wherein the light admitting shell is made of a plastic, glass or plexiglass material.

12. The apparatus of claim 11, wherein at least the frame, plurality of electric lights, and light admitting shell are integrally formed as a single module for attachment or installation to a building.

13. The apparatus of claim 9, wherein at least the frame, plurality of electric lights, and light admitting shell are integrally formed as a single module for attachment or installation to a building.

14. The apparatus of claim 12, wherein the louvers are made from a light admitting material that filters the light that enters the building.

15. A skylight/electrical light fixture module for attachment to a building to provide natural and artificial lighting, comprising:

a building skylight fixture for providing natural light to the inside of a building;

an electric light fixture coupled to the skylight fixture for providing electrically generated light when needed or desired, wherein the electric light fixture includes at least one electric light, is housed completely within the building skylight fixture, and is mounted to be within and below the span of area of the building skylight fixture where the natural light is admitted from outside the building; and an automatic shutter mounted below the light admitting shell and the electric light fixture.

16. The module of claim 15, wherein the automatic shutter includes a plurality of automatically adjustable shutters, and further comprising:

a light sensor; and a microprocessor coupled to the light sensor and programmed to automatically open and close the automatic shutter according to a desired light intensity in the building.

17. The module of claim 16, wherein the automatic shutter is a two-way type to adjust the amount of light by eliminating or reducing light when oriented in one direction and magnifying the amount of light when oriented in another direction.

18. The module of claim 17, wherein the building skylight fixture includes a shield that may be polarized or have a mirrored surface.

19. The module of claim 18, further comprising a potentiometer or switch to manually adjust the automatic shutter.

20. The module of claim 16, further comprising the following parts coupled together into an operable skylight and electrical light module including:

an internal frame for mounting parts of the electrical light module;

a light bulb for generating artificial light;

an electric motor for driving the automatic shutter;

a microprocessor for controlling the electric motor and/or light bulb; and a polarized shield for polarizing light through the module;

a programming device to set operation of the module to a desired performance, wherein all of the parts to the module are assemble into a single unit prior to delivery at a building onto which the module will be installed.

* * * * *